United States Patent [19]

Kidwell

[11] 4,320,687

[45] Mar. 23, 1982

[54] CYMBAL

[76] Inventor: Carl Kidwell, 711 Taylor, Moscow, Id. 83843

[21] Appl. No.: 208,857

[22] Filed: Nov. 21, 1980

[51] Int. Cl.[3] ..... G10D 13/06

[52] U.S. Cl. ..... 84/402; 84/406; 116/152; D17/22

[58] Field of Search ..... D17/22; 84/402, 406; 116/152

[56] References Cited

U.S. PATENT DOCUMENTS

| | | | |
|---|---|---|---|
| 2,559,143 | 7/1951 | Zildjian | 84/402 |
| 4,114,502 | 9/1978 | Zildjian | 84/402 |

OTHER PUBLICATIONS

The Music Trades, Jun. 1976, p. 78.

*Primary Examiner*—Lawrence R. Franklin
*Attorney, Agent, or Firm*—Wells, St. John & Roberts

[57] ABSTRACT

An elliptical cymbal or gong. The cymbal structure has a platelike configuration bounded by a continuous edge defining opposite elliptical areal surfaces about its periphery. The foci of the boundary ellipse are visually indicated at the outer surface of the cymbal or gong to guide the user in striking the cymbal at one of these locations.

6 Claims, 6 Drawing Figures

CYMBAL

BACKGROUND OF THE INVENTION

The present disclosure relates to an improvement in a cymbal or gong.

A conventional cymbal comprises a concave circular disk or plate, usually made of brass or bronze, which produces a sharp, ringing sound when struck. Cymbals are played either in pairs, by being struck together, or singly, by being struck with a drumstick or the like. A gong is typically a large bronze disk having an upturned rim. It is suspended by its rim in a vertical position and is sounded by striking with a stick or hammer that has a padded head.

The tone of a conventional cymbal or gong contains a blend of virtually all notes of the scale or their harmonic complements, made up of a fundamental tone or "bell tone" and overtones. The usual sound effect desired from a cymbal is a "crash". Much prior development work with respect to orchestral cymbals has been directed to the elimination of a dominant musical note which might discord with other instruments of the orchestra. The crash sound of the cymbal in any event maintains a well defined pitch. As in most conventional percussion instruments, the presence of inharmonic frequencies in the sound of a cymbal or gong prevents the listener from recognizing the tone of the percussion instrument.

An object of the present invention is to design a cymbal to create a specific recognizable pitch along with the usual ability to create rythmic noise and crashes. This combination should greatly enhance the use of the cymbal as a musical instrument playable in harmony with the sounds from other instruments.

An example of a prior patent relating to the tonal characteristics of a cymbal is U.S. Pat. No. 4,114,502 to Zildjian, which discloses a second mounting aperture through a cymbal to modify the characteristic cymbal tones when it is mounted through one or the other of the alternate apertures.

Another object of this invention is to provide a cymbal which can be designed mathematically to produce a predetermined characteristic pitch. This is accomplished by constructing the cymbal in the form of an ellipse.

DESCRIPTION OF THE PREFERRED EMBODIMENT

As used herein, the terms "cymbal" and "gong" shall be used interchangeably in referring to musical percussion instruments made from a sheet of metal and suspended either at their centers or their rims so as to be capable of being physically struck. The basic improvement which is the subject matter of this disclosure is the production of an elliptical cymbal or gong. As will be evident below, the physical characteristics of a cymbal can be readily incorporated within a gong, the only essential difference being the manner by which the particular instrument is mounted.

Figure 1:
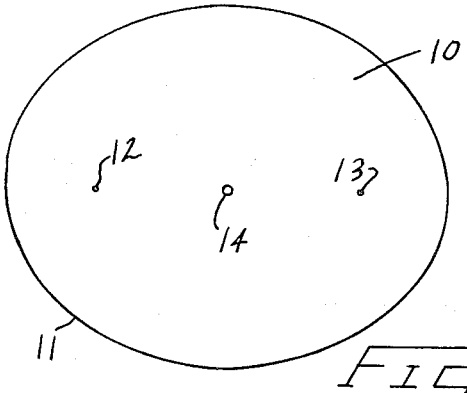
FIG. 1 is a plan view of the cymbal.
Figure 2:
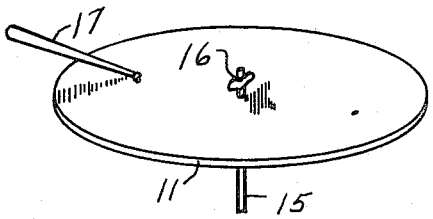
FIG. 2 is a perspective view illustrating use of the cymbal.

An example of a cymbal produced according to this invention is shown in FIGS. 1 and 2. This is a very basic form of the instrument, comprising a flat plate or sheet of metal bounded by an elliptical edge. The cymbal is denoted by the reference numeral 10. Its elliptical edge is designated at 11. The edge 11 is mathematically generated about first and second foci 12, 13. As shown, cymbal 10 includes a marking or other visual indicia at each of the foci 12, 13.

The cymbal 10 is provided with an open aperture or mounting hole 14 at its physical center. It appears preferable to approximately center the foci 12, 13 between the hole 14 and the cymbal ends along its major axis. When used on an upright stand (FIG. 2), the mounting hole 14 receives the upper end of the stand 15, which is capped by a releasable nut 16. This form of mounting, and the many alternate forms of cymbal mountings which are typically used in music ensembles, is well known in the art and no further details are believed necessary to an understanding of the present invention.

The cymbal 10 is adapted to be struck by a drumstick 17 or by other conventional devices, such as a brush or mallet. It is preferably struck at one of the foci 12, 13. The markings at the outer surface of the cymbal provide a visual indication of the location of the foci to guide the user in properly striking the cymbal 10.

By utilizing an elliptical boundary about the surfaces of the cymbal 10, one is able to design a cymbal with a predetermined desired pitch. By definition, an ellipse is a plane curve such that the sums of the distances of each point in its periphery from two fixed points or foci are equal. When the cymbal 10 is struck at either foci 12, 13, the radiating sound waves will be reflected back and forth between the foci along paths of equal length. As sound waves reach a point on the cymbal periphery they will be reflected to the opposite foci and the total distance traveled by the sound waves will be constant regardless of the particular path taken. The angle between the path from the first foci to a line perpendicular to the periphery and between such a line and the reflected path to the second foci will be equal.

Figure 3:
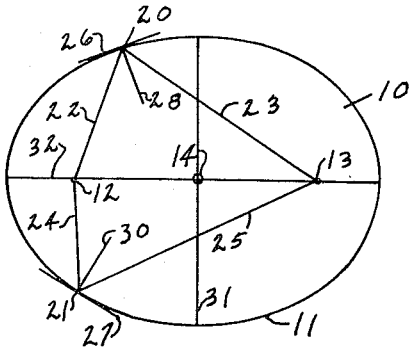
FIG. 3 is a diagram illustrating the geometric properties of an ellipse.

The geometric properties of an ellipse are schematically illustrated in FIG. 3. At the upper portion of the figure is shown an arbitrary point 20 on the periphery of cymbal 10. At the lower portion of the figure is a second arbitrary point 21. The length of path 22 from foci 12 to point 20 plus the length of the reflected path 23 from point 20 to foci 13 equals the combined lengths of the corresponding paths 24 and 25 illustrated with respect to point 21. Line 26 illustrates a straight line tangential to the curvature of the ellipse at point 20. Line 27 illustrates a similar tangential line at point 21. Line 28 is perpendicular or normal to line 26 and line 30 is perpendicular or normal to line 27. The angle between path 22 and line 28 is identical to the angle between line 18 and path 23. Similarly, the angle between path 24 and line 30 is equal to the angle between line 30 and path 25. Paths 22 through 25 represent sound wave paths through cymbal 10. They converge on the respective foci 12 and 13. Thus, when the cymbal 10 is struck at foci 12, the resulting sound waves will be concentrated at the two foci 13 and 12 until dissipated by sound radiation from the cymbal surfaces.

When cymbal is struck, sound waves are produced that traval radially outward from the point at which it was struck. These waves are reflected from that point along the total structure of the cymbal. The sound waves travel with a much higher velocity through metal than in air. They will therefore tend to be reflected and transmitted through the cymbal for a substantial time prior to their dissipation by radiation through the surrounding air.

The sound waves in the cymbal will be reflected at all points of its elliptical boundary toward the opposite foci. Since the reflected paths from each foci to the other are equal about the entire periphery of the cymbal, all portions of the acoustic waves traveling with a nearly uniform velocity through the metal cymbal structure from one foci will be reflected and reach the other foci at approximately the same time. At this point the waves will continue to travel through the foci, will be reflected again at the elliptical cymbal boundary or periphery and will be returned back to the originating foci. This process will repeat itself until the acoustic waves decay.

When the acoustic waves converge at a foci, they superimpose, or add to each other to form a single wave impulse which has the amplitude of the sum of the amplitudes of all of the contributing acoustic wave parts. The emission of the audio sound will vary in intensity directly proportional to the amplitude of the waves traveling through the metal. Thus, the strongest and most important portions of what will be actually heard as sound from the cymbal will result when the waves traveling through the metal pass through and combine at each of the foci.

Figure 4:
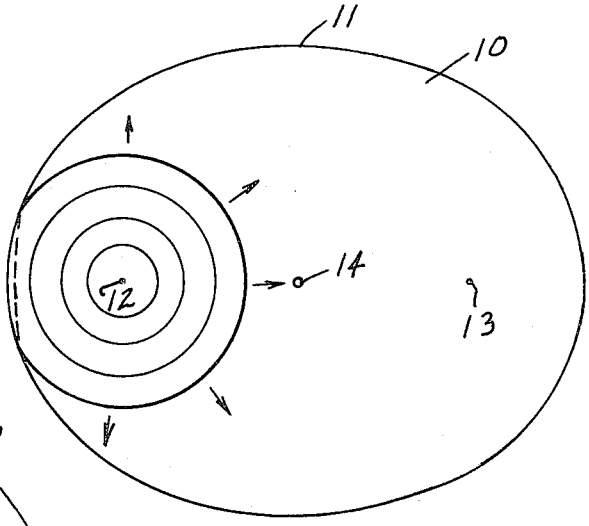
FIG. 4 is a diagram illustrating initial formation of sound waves at a first foci on an elliptical cymbal.
Figure 5:
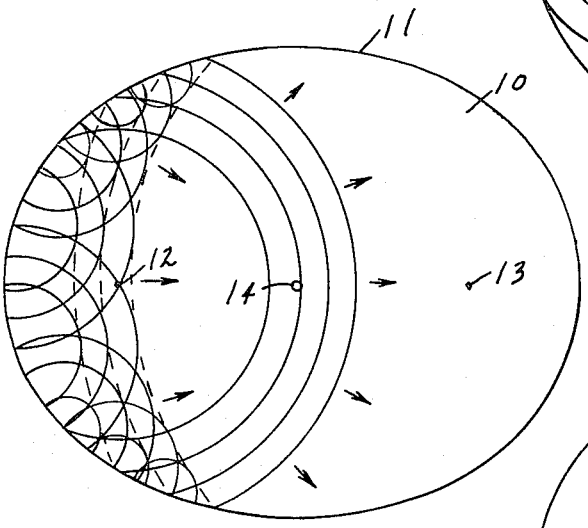
FIG. 5 illustrates subsequent development of a reflective wave front.
Figure 6:
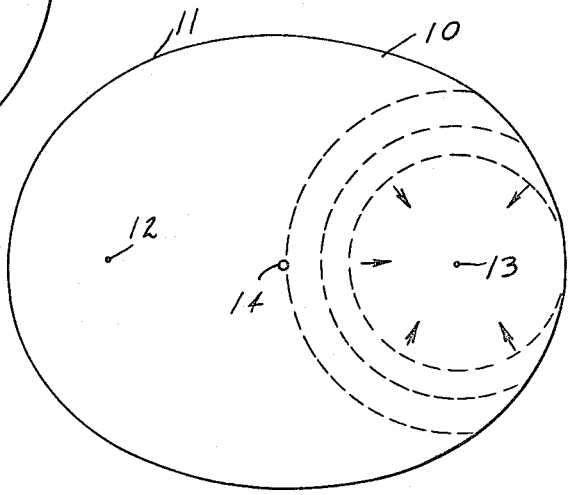
FIG. 6 illustrates collapse of the wave form at the second foci.

FIGS. 4, 5 and 6 schematically illustrate the general manner in which the acoustic waves propogate from the point of impact on the cymbal, are reflected at its periphery, and then converge at the remaining foci. FIG. 4 illustrates, in very simplistic symbols, the initial propagation of acoustic waves radiating outward from foci 12, when struck so as to cause the cymbal to be vibrated. FIG. 4 shows the continued propagation of these waves toward the right, and the reflection of the waves as they reach the elliptical boundary wall of the cymbal toward its left. This creates a concave wave front facing toward the right and traveling through the cymbal structure toward the opposite foci 13. As shown in FIG. 6, these wave fronts converge and collapse about the foci 13, reinforcing one another and transmitting an audio wave that can be perceived by the human ear. After converging upon the foci 13, the vibratory energy within the wave will pass through the foci and begin to radiate outwardly, repeating the process from one side of the cymbal to the other.

The major frequency of the cymbal can readily be calculated by mathematical means. The distance (d) along the path taken by an acoustic wave reflected from one foci to the other is equal to the square root of the separation between the foci squared, plus the length of the minor axis of the ellipse. Referring to FIG. 3, the minor axis is shown as line 31 and the major axis is shown as line 32. The length of the acoustic wave path is defined by the following equation:

$$d = \sqrt{(f_1 - f_2)^2 + M_1^2}$$

where:

$f_1$-$f_2$ is the distance between foci 12, 13; and $M_1$ is the length of the minor axis of the ellipse.

The time required for an acoustic wave to travel the distance (d) can be obtained by dividing this result by the wave velocity. Dividing this time into one second will yield the number of times the wave will collect at either foci per second or the frequency of the audio wave.

The complete formula for determination of the frequency of the audio wave is as follows:

$$c = \frac{v}{\sqrt{(f_1 - f_2)^2 + M_1^2}}$$

where:

c=audio wave frequency v=velocity of acoustic wave in metal $f_1$=graphic location of first foci along major axis $f_2$=graphic location of second foci along major axis $f_1$-$f_2$=linear distance between foci $M_1$=length of the minor axis across the cymbal To produce a predetermined tone from an elliptical cymbal, the cymbal would be constructed with the desired dimensions of the minor axis and distance between foci required according to the above equation in order to produce that tone. The propagational velocity of the acoustic wave in a particular metal will be constant.

The elliptical shape of the cymbal will produce the desired tonal effect regardless of small deviations of the planar elliptical shape. It specifically will be satisfactory in a concave cymbal. In general, the cymbal or gong should be constructed in a platelike configuration, which can be either flat or concave, wherein the cymbal is bounded by a continuous edge defining opposed elliptical areal surfaces about its periphery. The main feature that yields the desired note is that the cymbal, whether flat or concave, is elliptically shaped such that upon its being struck at the foci or equivalent point of symmetry analogous to a foci or a concave cymbal, the acoustical waves propagate to the elliptical boundary, are reflected, and then collapse and superimpose at the opposite foci or point of symmetry, and then repeat this process.

One or more apertures or holes at the center of the cymbal for mounting purposes, or holes adjacent its rim for suspending a gong, does not hinder the desired results, since the small portion of the acoustical waves that are disrupted by this interference is negligible in comparison to the total acoustic wave energy available. Small deviations of shape can be neglected because the speed of the waves in the metal are such that the acoustical energy would have already dissipated into an audible sound before deviations of shape could cause a substantial noticeable effect in the resulting tonal qualities.

The locations of the foci 12, 13 which indicate the points at which the cymbal should be struck, can be visually indicated by any suitable method of marking the outer surface of cymbal 10. Paint or an adhesive label could be used, but would deteriorate with time and usage. The preferable way of indicating the positions of the foci 12, 13 is to provide circular surface grooving on the outer face of the cymbal. The grooving should be concentric and centered about each of the foci. These circular grooves around each foci would help to transmit the audio waves and make the cymbal more sound-effective.

Variations in sound of the cymbal are possible by design and placement of surface grooves, location and choice of mountings, chemical surface treatments, thickness variations across the cymbal area, changes in cymbal size and proper choice of the metal composition from which the cymbal is manufactured. Sound qualities can also be modified by use of different strikers or different methods of imparting vibration to the cymbal. The same design factors apply to design and production of an elliptical gong.

Further modification of the cymbal can be achieved by selective choice of the amount of concavity provided across the cymbal, and by selection and design of a center cup or dome protruding outward beyond the normal plane of the remainder of the cymbal. Such a dome will modify the transmission of sound through the center portion of the cymbal and introduce variations in tonal qualities by partially blocking or re-routing movement of the sound waves from one foci to the other.

Having described my invention, I claim:

1. A musical instrument adapted to produce a ringing sound when struck, comprising a relatively thin, plate-like body, the periphery of which defines an ellipse.

2. The musical instrument of claim 1 wherein said instrument is a cymbal having a mounting hole formed through the physical center of said body.

3. The musical instrument of claim 1 wherein said instrument is a gong having a rim around said periphery and having at least one mounting hole formed through said rim.

4. The musical instrument of claim 1, 2, or 3 having visual indicia at one or both foci of said ellipse.

5. The musical instrument of claim 1 wherein said plate-like body is convex.

6. The musical instrument of claim 1 wherein said plate-like body is flat.

* * * * *